US006083118A

United States Patent [19]

Martins et al.

[11] Patent Number: 6,083,118

[45] Date of Patent: Jul. 4, 2000

[54] GOLF CLUB HEAD AND METHOD OF MANUFACTURE

[75] Inventors: Roberto Ruiz Martins, San Paulo, Brazil; Joseph Sery, 3683 Foxgrove Pl., San Diego, Calif. 92130

[73] Assignee: Joseph Sery, San Diego, Calif.

[21] Appl. No.: 09/196,445

[22] Filed: Nov. 19, 1998

Related U.S. Application Data

[63] Continuation-in-part of application No. 08/902,750, Jul. 30, 1997, abandoned.

[51] Int. Cl.[7] ..... A63B 53/08

[52] U.S. Cl. ..... 473/334; 473/335; 473/345; 473/346

[58] Field of Search ..... 473/324, 334, 473/342, 349, 312, 304, 305, 326, 341

[56] References Cited

U.S. PATENT DOCUMENTS

| | | | |
|---|---|---|---|
| 5,332,223 | 7/1994 | Johnson | 473/324 X |
| 5,489,097 | 2/1996 | Simmons | 473/341 |
| 5,584,770 | 12/1996 | Jensen | 473/350 |
| 5,669,830 | 9/1997 | Bamber | 473/350 |
| 5,735,755 | 4/1998 | Kobayashi | 473/342 |

*Primary Examiner*—Kien T. Nguyen
*Attorney, Agent, or Firm*—Brown, Martin, Haller & McClain, LLP

[57] ABSTRACT

A golf club head has a perimeter formed by bending a tube into a desired perimeter shape, and securing a member over at least part of the loop to at least cover the loop opening and form the striking face. At least one plug of weighting material fills a portion of the tube at a predetermined location on the loop to form a weighted portion. Successive plugs of the weighting material and a lighter weight material may completely fill the tubular loop. Each plug is inserted while the material is in a flowable condition and the loop is held in a suitable orientation based on the location of the plug. The material is allowed to harden before adding the next plug.

26 Claims, 4 Drawing Sheets

GOLF CLUB HEAD AND METHOD OF MANUFACTURE

CROSS REFERENCE TO RELATED APPLICATIONS

This application is a Continuation In Part of application Ser. No. 08/902,750 filed Jul. 30, 1997 now abandoned.

BACKGROUND OF THE INVENTION

The present invention relates generally to golf club heads and methods of making such heads, and is particularly concerned with golf club heads having peripheral weighting and methods of weighting such heads.

Various techniques have been proposed in the past for weighting golf club heads at the perimeter and elsewhere, to produce improved ball striking properties and enhance performance. Such techniques may be applied to any type of golf club, such as woods, irons, and putters. In U.S. Pat. No. 5,312,106 of Cook, for example, a borehole is formed in the club head parallel to the striking face and to the ground at the instant of striking the ball, and the borehole is partially filled with tungsten powder to create a "sweet line" for ideal striking of the ball.

U.S. Pat. No. 5,540,437 of Bamber describes a perimeter weighted golf club in which a weighted perimeter portion of the club head is secured to the hitting surface by a spacer so that the weighted portion can be disposed further outward from the hitting surface. In one version, the club head has a tubular portion or frame which is much lighter in weight than the solid metal frame of perimeter weighted golf clubs. A weighted portion outboard of the tubular frame may be secured to the tubular frame by spacers. Alternatively, the outer wall of the tubular frame may be made thicker than the inner wall to provide desired peripheral weighting.

SUMMARY OF THE INVENTION

It is an object of the present invention to provide a new and improved golf club head with perimeter weighting and a method of making such a head.

According to one aspect of the present invention, a golf club head is provided which comprises a tube shaped to form a predetermined golf club head perimeter in the form of a loop having a toe end, a heel end, an upper portion and a lower portion, a member secured to the loop to form at least part of a striking face for the club head, and at least one predetermined portion of the tube being filled with a weighting material of heavier weight than the tube material at a predetermined location about the head perimeter.

In a preferred embodiment of the invention, the loop is filled with at least two different materials in different portions of the loop, the materials comprising a first material of heavier weight and a second material of lighter weight than the first material.

Preferably, the tube forming the head perimeter loop also includes a hosel extending from the loop for integration with a golf club shaft. The tube may form just the hosel and head peripheral loop, or a single tube may form both the shaft and the head perimeter of a golf club, with one end of the tube being bent to form the loop defining the periphery of the head. The member attached to the loop may be a plate secured over a front portion of the loop to cover the loop as well as the central opening of the loop, or may be simply a plug filling the central opening. In the latter case, the striking face is formed by forward portions of both the plug and loop.

Preferably, the forward portions of the tube forming the loop are flattened, either to form a flat attachment surface for the plate forming the striking face, or to form a continuation of the striking face where a plug closes the central loop opening. The head may be an iron, a putter, or a wood with appropriate selection of the shape formed by the tube loop.

Alternatively, the tube may be enclosed inside a shaped head of lightweight material such a polyurethane, aluminum, or the like. The head may be of plastic material such as polyurethane or the like, and may be molded around the tube to form a suitable iron, putter, or wood shape. A face plate is then suitably secured to the front of the molded club head, which may have a recess for this purpose.

By encasing the weighted tube within a light weight, solid or hollow metal or plastic body or shell, the appearance is made more like that of a conventional club. At the same time, the lightweight body will not change the weighting characteristics of the tube.

According to another aspect of the present invention, a method of making a golf club head is provided which comprises the steps of taking a tube having a first end and a second end, bending a first end portion of the tube to form a loop of predetermined shape defining the periphery of a selected golf club head, the loop defining a heel end, a toe end, a lower portion and an upper portion of a club head perimeter, filling at least one predetermined portion of the loop with a first, weighting material which is heavier than the tube material, and securing a member forming at least part of a striking face to the loop.

Preferably, at least one second predetermined portion of the loop is filled with a second material lighter than the first material to provide a selected perimeter weighting configuration. The tube may be filled with the lighter and heavier materials by injecting flowable material into a selected portion of the loop while holding the loop in a predetermined orientation, allowing the material to set in that orientation, and then flowing a second flowable or liquid material into the loop to fill a second portion with the loop in a different orientation, and allowing the second material to set in that orientation, repeating the procedure until predetermined portions of the loop are filled with the lighter and heavier materials as desired.

This technique may be used to produce any desired perimeter weighting effect. For example, heavier material may be introduced to fill the toe end of the loop with the loop oriented upright, with lighter material along the upper and lower portions of the loop and heavier material filling the heel end of the loop, to produce a club weighted at the toe and heel. This provides an enlarged "sweet spot" and larger moment of inertia to the club head. In another alternative, a heavier toe may be used on short hitting irons, and a heavier heel may be used on longer hitting irons. Alternatively, heavier material may fill the upper portion of the tubular loop with lighter weight material along the lower portion, producing a high gravity point. This arrangement may be reversed to produce a club head with a low gravity point. The club may be customized in this way for any particular player's hitting characteristics or particular playing conditions.

The club head and method of this invention therefore provides any desired perimeter weighting arrangement in a tubular loop forming the periphery of the club head, without having to produce a completely different club head for each different weighting condition. The technique may be used in any type of club head, including irons, woods, and putters. The tubular, weighted perimeter is of relatively simple construction and can be formed integrally with the hosel or the entire shaft of the club, providing an integral, uniform club head periphery and shaft. Any desired perimeter weighting can be provided in order to enhance the so-called "sweet spot" of the club head and thus improve performance, or to produce club heads having various different ball striking capabilities.

BRIEF DESCRIPTION OF THE DRAWINGS

The present invention will be better understood from the following detailed description of some preferred embodiments of the present invention, taken in conjunction with the accompanying drawings, in which like reference numerals refer to like parts, and in which.

DESCRIPTION OF THE PREFERRED EMBODIMENTS

Figure 1:
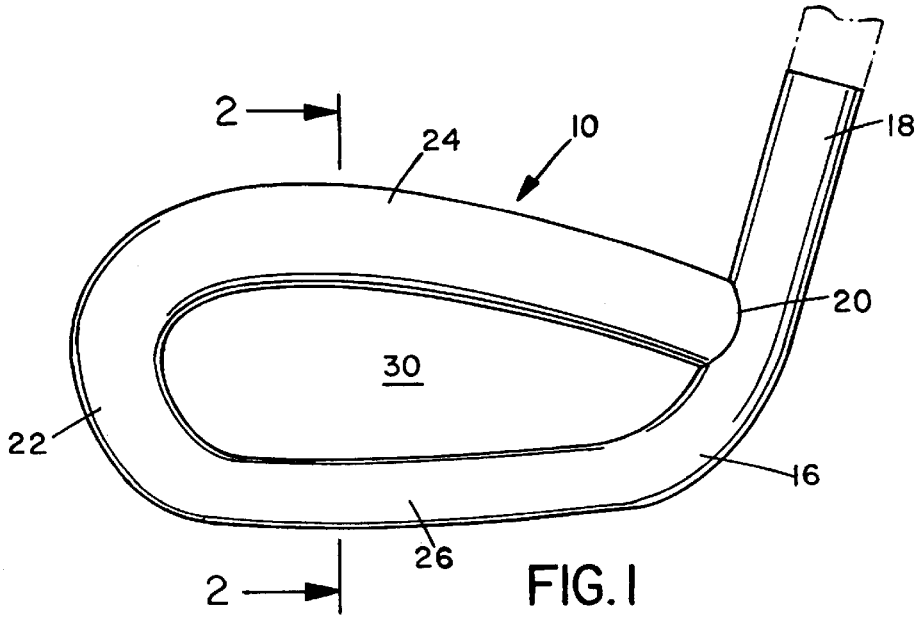
FIG. 1 is a front view of a preferred configuration of a perimeter frame of a golf club head according to a first embodiment of the invention.
Figure 2:
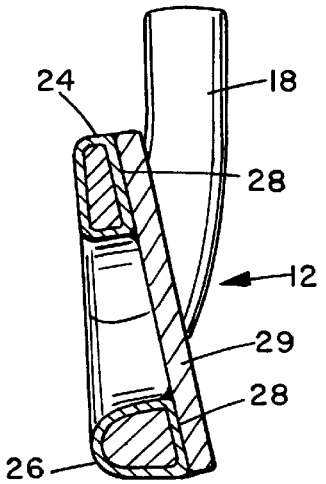
FIG. 2 is a sectional view taken on line 2—2 of FIG. 1, with a striking face attached.
Figure 3:
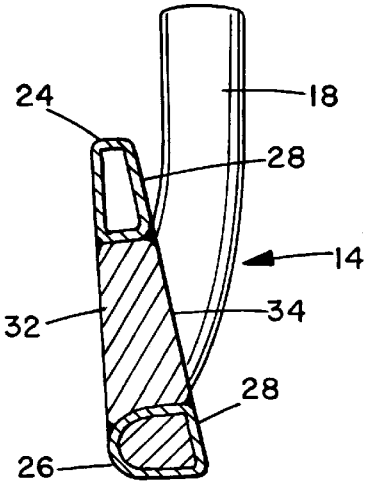
FIG. 3 is a similar sectional view illustrating an alternative striking face arrangement.

FIG. 1 illustrates a tubular loop 10 forming the periphery of a golf club head according to a first embodiment of the invention, while FIGS. 2 and 3 illustrate two alternative club heads 12,14 using the loop 10 of FIG. 1. FIGS. 4–7 illustrate some alternative perimeter weighting arrangements.

In FIG. 1, the perimeter of a golf club head is formed by bending one end portion of a tube to form a loop 10 in the desired shape, leaving a portion of the tube projecting from a heel portion 16 of the loop to form a hosel 18. Alternatively, the tube may be of sufficient length to form the perimeter loop 10 integrally with the entire golf club shaft. In the embodiment of FIGS. 1–3, the club head is in the shape of an iron, although other alternative club head shapes may also be used, as described in more detail below.

The end 20 of the tube is suitably secured to the inner face of the loop at the heel end by welding or the like. The tube may be of any suitable material as is commonly used in golf club shafts and heads, such as titanium, stainless steel, graphite and the like.

The loop 10 defines a club head perimeter having a heel portion 16, toe portion 22, upper portion 24 and lower portion 26. The tube is preferably flattened along at least the front face 28, as indicated in FIGS. 2 and 3, and is preferably of generally D-shaped cross-section at least along the lower portion, with the rounded part of the D-shape facing rearwardly away from the striking face of the club. The tubular cross-section is of larger width at the lower portion 26 than at the upper portion 24, while the height of the cross-section is larger at the upper portion than the lower portion. The tube is preferably of uniform, circular cross-section prior to bending to form loop 10, and is then reshaped in any suitable manner to provide the desired varying cross-section. Alternatively, the circular cross-section can be manipulated prior to bending, by swaging or drawing down, or expanding to accommodate various shapes and construction designs. It is desirable to provide a larger cross-section along the bottom of the club head to provide the desired lift to the ball.

A suitable striking plate 29 may be secured across the front face 28 of the loop, as illustrated in FIG. 2. Alternatively, the central opening 30 of the loop may be filled with a plug 32 which is flattened at its front face 34 and flush with the front face 28 of the loop so that the faces 28 and 34 together form a striking face, as illustrated in FIG. 3. In the case of a wood-style club, as in FIGS. 8 and 9, the striking face can be shaped with the desired bulge and roll radii. The plate 29 and insert 32 may be of the same material as the tube forming loop 10, and are suitably secured to the loop by welding or the like, as illustrated in FIGS. 2 and 3. Alternatively, plate 29 or insert 32 may be of other materials, including non-metallic materials such as polyurethane. It will be understood that the striking face in either FIG. 2 or FIG. 3 will be provided with any conventional score line configuration, as desired.

Figure 4:
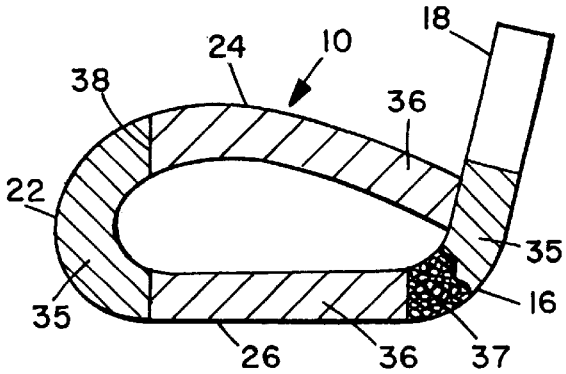
FIG. 4 illustrates one possible weight distribution arrangement for the iron-type club head of FIGS. 1–3.

Preferably, the tube is filled at least around loop 10 with two different materials in different regions of the loop. FIG. 4 illustrates one possible weighting configuration suitable for an iron. In FIG. 4, the heel and toe portions of the loop are filled with a first, weighting material 35 while the upper and lower portions of the loop are filled with a lighter weight material 36. One of the materials is a heavy material such as lead tungsten or the like, while the other material is a lighter material such as epoxy foam or the like. The two materials are preferably injected or poured into the tube while in a liquid or flowable condition. In a preferred embodiment of the invention, the weighting material comprises a mixture of compacted tungsten balls 37 and epoxy. The balls 37 are made by compacting tungsten powder into a suitable die with glue and, optionally, sintering the product in a furnace. This produces a density of 14–15 gm/cc, as compared to 11 gm/cc for tungsten powder. Alternatively, the first, weighting material may be a mixture of tungsten powder or sintered tungsten parts and epoxy, or molten lead or other heavy metal. The second, lightweight material may be a foam or lightweight plastic or epoxy.

Figure 11:
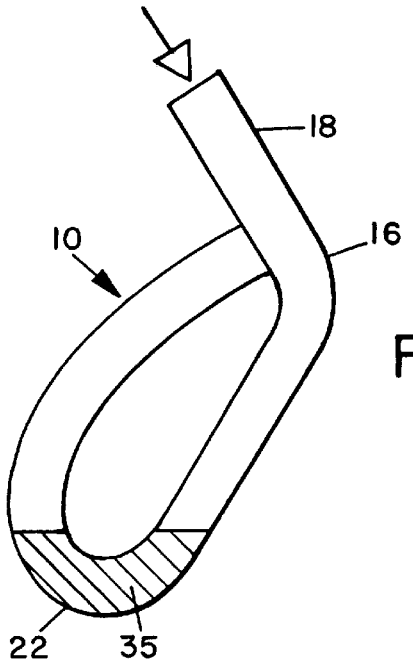
FIG. 11 illustrates a method for filling a portion of the loop with a weighting material.

FIG. 11 illustrates one possible method for filling the desired portions of the tubular loop with the different weight materials. The lightweight material 36 filling the upper portion of the loop may be inserted into the end of the tube prior to bending into the loop shape. Alternatively, it may be injected up to the end 38 of the upper filled portion with the loop oriented upright with the heel end downwards, and allowed to harden. The loop is then oriented upright with the toe portion facing downwards, as in FIG. 11, and the liquid material 35 is then poured or injected via the open end of hosel 18, for example, in sufficient quantity to fill the toe end of the loop. The loop is left in this orientation for a sufficient time for the material 35 to cure or harden, and the second material 36 is then poured in to fill the lower portion of the loop, still holding the loop in the orientation of FIG. 11. The second material 35 is then allowed to harden. Finally, the loop is returned to the orientation of FIG. 4, and a second amount of the first material 35 is poured in to fill the heel portion of the loop. This is then allowed to harden, producing the weighting configuration as illustrated in FIG. 4.

Rather than pouring or injecting liquid material via hosel 18, small holes may instead be made around the loop and the appropriate material injected through the hole, which is subsequently plugged. Where the loop is formed from a single tube integral with the golf club shaft, a suitable flexible injection pipe or needle may be inserted through the upper end of the shaft down to the loop, so that material is injected into the loop rather than flowing along the entire length of the shaft.

Preferably, the tubular loop is filled around the entire perimeter of the club head as illustrated, since this will reduce vibrations. However, in alternative embodiments, the weighting material 35 only may be used to fill appropriate regions of the loop, with the remainder of the loop being left empty.

Another alternative technique for providing any desired perimeter weighing arrangement uses one or more rods of a heavy metal such as lead. One or more lengths of lead rod may be inserted into the tube while it is still straight, and secured in a predetermined location. The tube is then bent, along with the rod, or rods, to form the desired peripheral shape. The, or each, rod is bent along with the tube so that it is locked securely in the desired position.

FIG. 4 illustrates one possible heel and toe weighting configuration which may be used, and which is particularly suitable for an iron-type club head. Heel and toe weighting is generally recognized as increasing the so-called "sweet spot" area and thus improving performance of a golf club. Additionally, it will increase the moment of inertia. However, alternative weighting configurations may be used both in irons and other types of clubs. It will be recognized that any desired arrangement of the different materials may be achieved by suitable orientation and re-orientation of the loop while injecting or pouring material into the currently lowermost portion of the loop and allowing it to harden.

Figure 5:
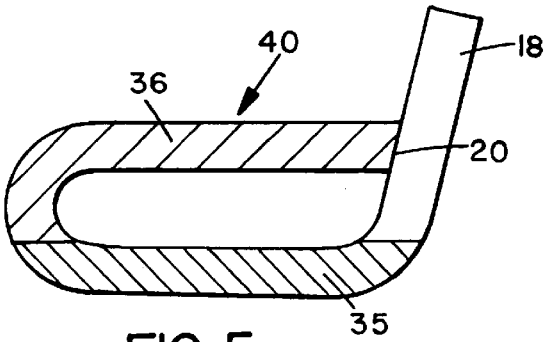
FIGS. 5–7 illustrate different weight distribution arrangements for a putter.
Figure 6:
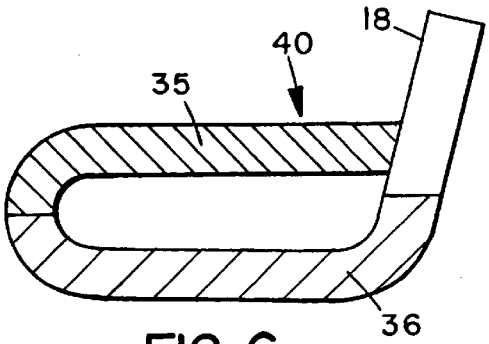
Figure 7:
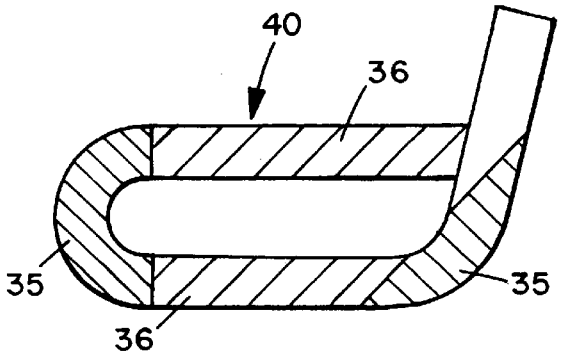

FIGS. 5–7 illustrate alternative club heads in which a tube is bent to form a loop 40 in the general shape of a putter. As in the previous embodiment, the putter loop 40 has an integral hosel 18, or may be integral with the entire golf club shaft, eliminating the hosel 18. Each of the club heads of FIGS. 5–7 has a different weighting configuration.

In FIG. 5, heavy material 35 fills a lower portion of the loop, while an upper portion is left empty or filled with lighter material 36 such as epoxy foam. This produces a club head with a low center of gravity. In a putter, this type of weighting may be used for putting on a slow green. For a slow green, it is desirable to produce a rolling action on striking the ball, and this is achieved with a putter having a low center of gravity. A similar weighting arrangement may also be useful for an iron as in FIG. 1, to produce a higher moment of inertia. In this case, the heel and toe may also be weighted for enhancing the sweet spot.

In FIG. 6, the arrangement is reversed with the heavy material 35 filling the upper portion of the loop, and lighter material 36 filling the lower portion, providing a high center of gravity. This arrangement is suitable for a putter for use on a fast green. The high center of gravity will cause the ball to skid rather than roll, slowing down the ball and reducing the risk of over shooting the hole. This type of weighting is only suitable for putters.

In FIG. 7, a heel and toe weighted putter is illustrated. Heavy material 35 fills the heel and toe regions of the loop, while the remainder of the loop is filled with lightweight material 36. This will produce an enlarged "sweet spot" for improved ball striking properties.

In the past, different head designs were required to provide the different weighting arrangements of FIGS. 5–7, requiring different molds or manufacturing processes. This weighting technique combined with a tubular head periphery allows the same basic head to be weighted in any number of different ways, simply by changing the location of the heavy and lightweight material in the loop. Thus, a large number of differently weighted heads can be produced at much lower expense than in the past.

Figure 8:
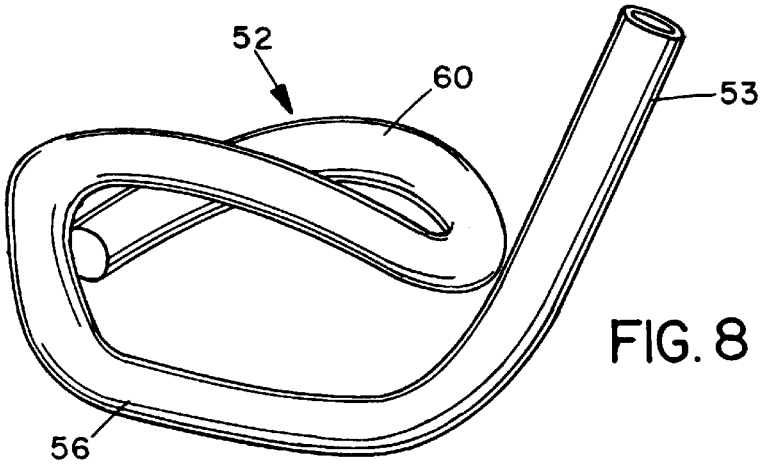
FIG. 8 is a perspective view of a tubular frame suitable for a wood-type club head.
Figure 9:
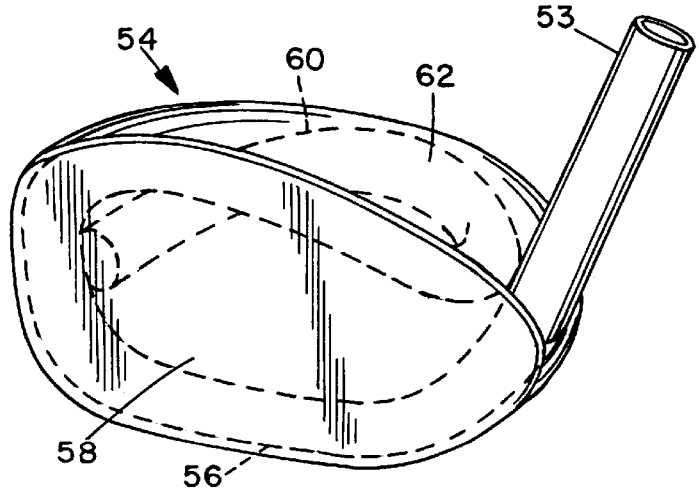
FIG. 9 illustrates a club head incorporating the frame of FIG. 8.

The club heads of FIGS. 1–7 may be designed as irons or putters by suitable selection of the perimeter shape and the head dimensions. FIGS. 8 and 9 illustrate how a tube may be bent to form a peripheral frame 52 and hosel 53 of a wood-type club head 54. Tube 50 is bent to form a first loop 56 defining the periphery of the striking face, and then to form a second loop 60 defining the rear body of the head 54. A suitable shaped shell 62 is attached around the rear loop 60 to form the rear body of the club head, and a plate 58 formed with suitable bulge and roll radii is welded or otherwise secured across the front loop 56 to form the striking face. The portion of the tube projecting from the club head may form the hosel alone, as in FIGS. 7 and 8, or may be extended upwardly to form the entire shaft of the golf club.

As in the previous embodiment, the tubular loops forming the peripheral frame of the club head may be filled with weighting material in selected regions to produce a desired perimeter weighting effect. The heavier and lighter materials 35 and 36 are preferably poured into the formed tubular loop in liquid form, as in the previous embodiments, and allowed to harden before adding the next portion of material. Preferably, the rear loop 60 includes heavier material 35 at the rear of the club head, moving the center of gravity rearwardly from the striking face, which is considered to be desirable in a wood and will produce a higher moment of inertia, resulting in less twisting on impact with the ball. The front loop 56 may be weighted at the heel and toe similar to the iron perimeter loop 10 of FIG. 4.

In the embodiment of FIG. 9, the weighted, shaped tube 52 of FIG. 8 is enclosed in an outer shell of a wood-type shape, which is preferably of a light weight metal such as aluminum so that the shell does not affect the weighting characteristics of the tube. Alternatively, the tube 52 may be enclosed in a molded, solid body of suitable lightweight material such as polyurethane or aluminum, which is molded around the tube to form the same general shape as in FIG. 9. This provides a wood club head which is of conventional appearance, while at the same time providing desirable perimeter weighting characteristics for improved performance.

Figure 10:
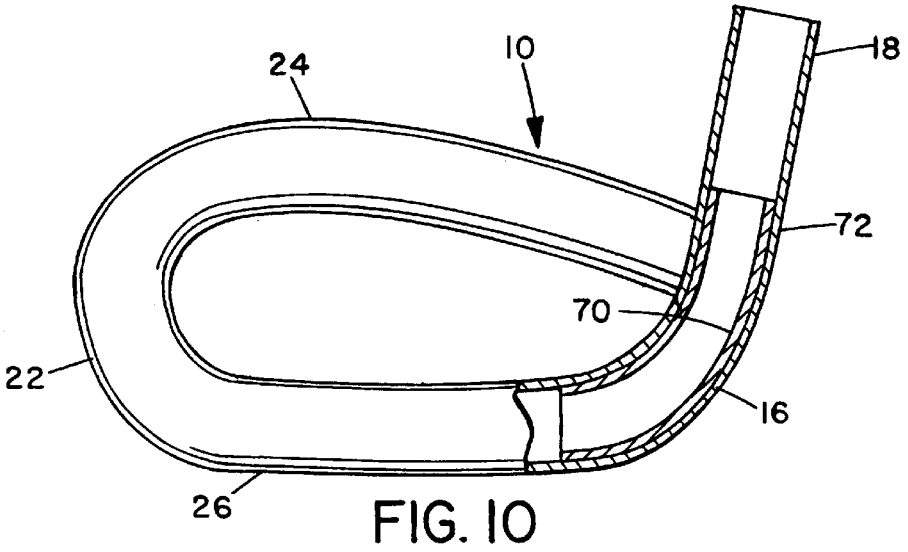
FIG. 10 is a partially broken away view similar to FIG. 1 illustrating a modification.

The heel region 16 of a club head must withstand the most force on impact with the ball. FIG. 10 illustrates a modification of the embodiment of FIGS. 1–4 in which the heel region 16 is reinforced. The embodiment of FIG. 10 is otherwise identical to that of FIGS. 1–4, and like reference numerals have been used for like parts as appropriate.

In FIG. 10, a second, inner tube 70 is secured to the outer tube 72 in the heel region 16 so as to provide a thicker wall and greater strength in this area. The tube 70 is preferably secured inside the outer tube by welding, bonding or the like prior to bending both tubes into the loop shape illustrated in FIG. 10, in other words while both tubes are straight. This creates a thicker wall at the location where the majority of the force will be applied.

Alternatively, the wall thickness along the tube 72 may be varied prior to bending the tube into the desired loop shape, to provide a thicker wall in certain areas such as at the heel. This may be done by bending a plate of variable thickness to form the tube, or by drawing a formed tube to produce a varying thickness. The wall can then be made thinner in certain areas to enhance the variable weighting around the loop, while being thicker in other areas where greater strength is required.

Figure 12:
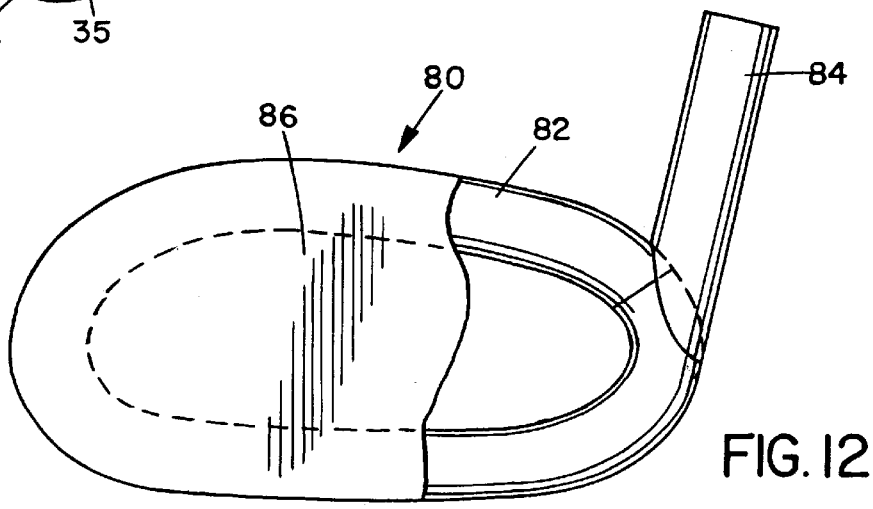
FIG. 12 is a partially broken away front view of a club head according to another, modified embodiment.

FIG. 12 illustrates a modified club head 80. In this embodiment, the perimeter of the club head is formed from a length of tube which is bent to form a loop 82 only. Unlike the previous embodiments, the loop 82 is not integral with hosel 84. The interior of loop 82 may be suitably weighted by injecting material through small holes in the tube wall at the appropriate locations. A striking plate 86 and hosel 84 are suitably welded or otherwise secured to loop 82. The striking plate 86 and hosel 84 may be separately welded to the loop, or may be formed in one piece and welded to the front face of loop 82.

Figure 13:
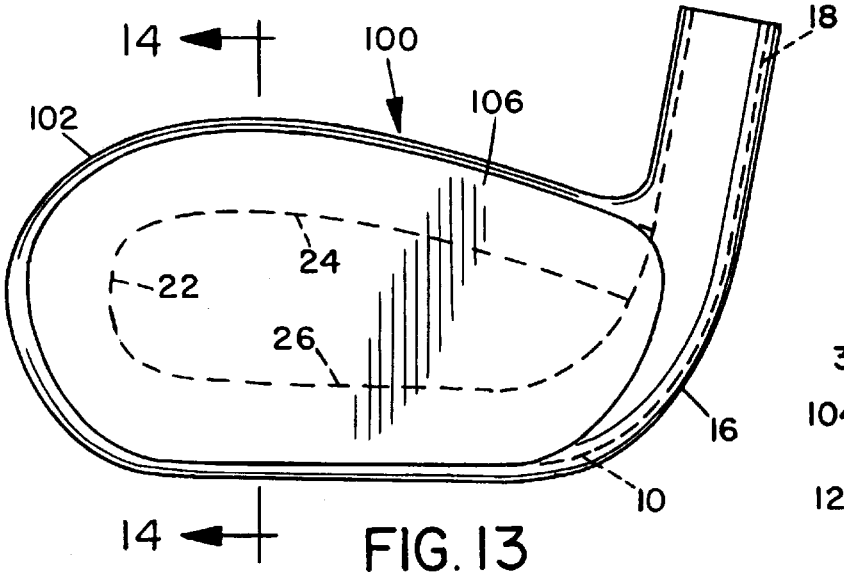
FIG. 13 is a front view of a golf club head according to another embodiment of the invention.
Figure 14:
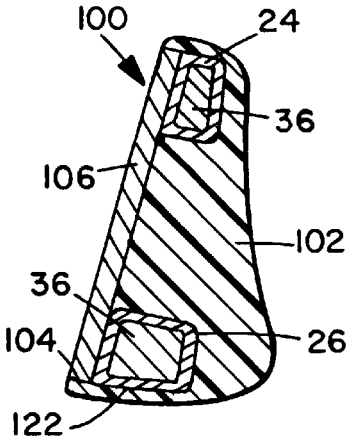
FIG. 14 is a cross-section on the lines 14—14 of FIG. 13.

FIGS. 13 and 14 illustrate a golf club head 100 according to another embodiment of the invention. The club head 100 is of an iron type shape similar to that of FIGS. 2 and 3, and incorporates the same basic tubular perimeter loop 10 as illustrated in FIGS. 1 to 3, and like reference numerals have been used for like parts as appropriate. As in the first embodiment, the loop 10 defines a club head perimeter having heel portion 16, toe portion 22, upper portion 24 and lower portion 26. The loop is formed from a tube which is filled with two different weighting materials in predetermined regions. As in the embodiment of FIGS. 1 to 3, the heel and toe regions are filled with a first, heavier weighting material, while the upper and lower portions of the loop are filled with a lighter weight material 36.

In the iron of the first embodiment, a face plate 29 is simply secured over the front face of the loop 10. However, this results in a club head of unusual appearance. In the embodiment of FIGS. 13 and 14, the entire loop is enclosed or embedded in a body 102 of a suitable lightweight material. In the illustrated embodiment, body 102 is molded around the loop and is of lightweight plastics material such as polyurethane. The molded body has a front facing recess 104 in which a suitable metal face plate 106 is bonded. This provides a club head of more conventional appearance, which may be preferable to golfers, while the light weight material of body 102 does not change the heel and toe weighting characteristics provided by loop 10.

The body 102 may be a solid, molded body as illustrated, and may be of any suitable lightweight plastic or metal material, such as polyurethane, aluminum, or the like. Alternatively, the loop 10 may be enclosed in a suitably shaped outer shell, in a similar manner to the wood type club head of FIG. 9.

Figure 15:
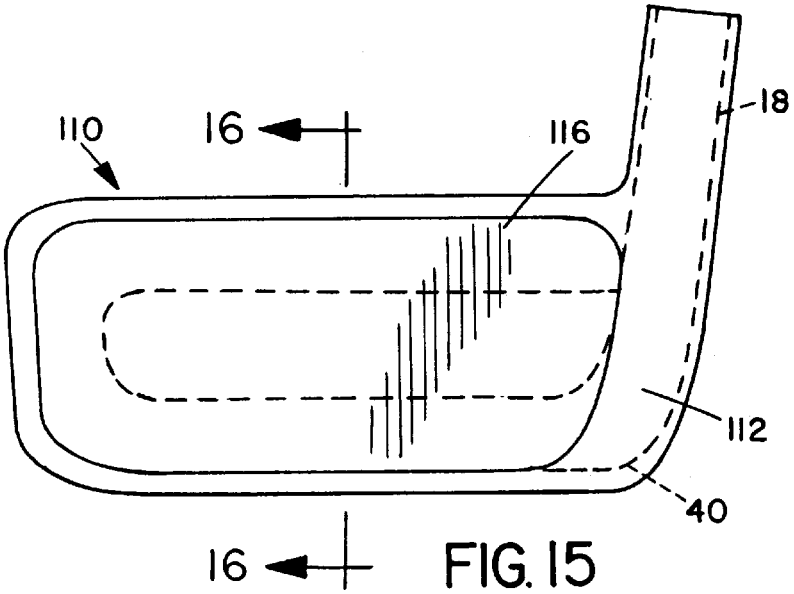
FIG. 15 is a front view of a putter-type club head of similar construction to the iron of FIGS. 13 and 14.
Figure 16:
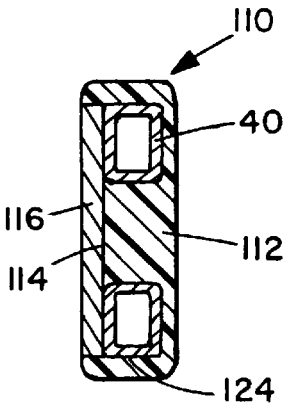
FIG. 16 is a cross-section on the lines 16—16 of FIG. 15.

FIGS. 15 and 16 illustrate a golf club head 110 of similar construction to that of FIGS. 13 and 14, but of a putter shape. The putter 110 comprises a loop or tube 40 bent into the general peripheral shape of a putter, as in FIGS. 5 to 7, and like reference numerals have been used for like parts as appropriate. Although this is not illustrated in FIGS. 15 and 16, it will be understood that the loop 40 will be suitably filled with light and heavy weighting materials according to any desired peripheral weighting characteristics, for example as illustrated in any one of the alternatives of FIGS. 5 to 7. The tube is preferably of generally square or rectangular cross-section, as illustrated in FIG. 16.

The weighted loop 40 is then embedded in an outer body 112 of a suitable lightweight material, such as polyurethane. The polyurethane material may be suitably molded around the loop 40, and is preferably formed with a recess 114 in which a metal face plate 116 is mounted. Alternatively, a shell of a suitable lightweight metal such as aluminum may be secured to enclose loop 40, in a similar manner to the wood-type head of FIG. 9. In either case, the club head will be of a more conventional appearance, while the lightweight material forming the outer body will not interfere with the weighting characteristics of loop 40.

Figure 17:
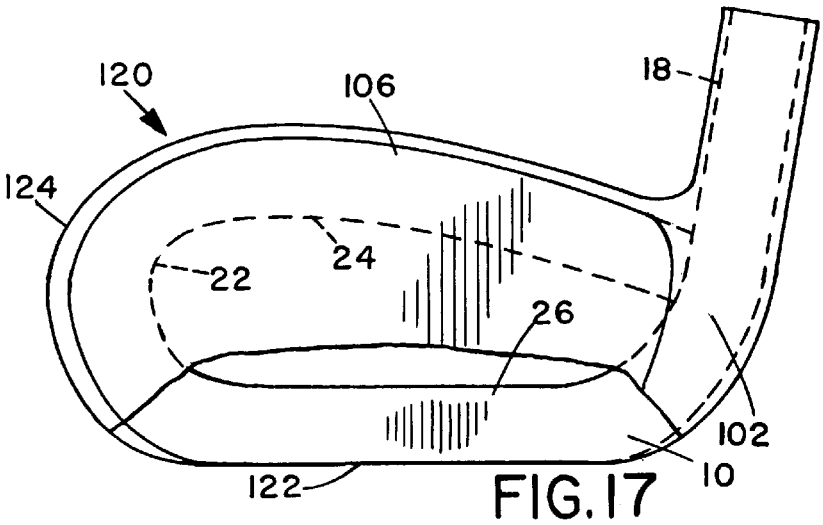
FIG. 17 is a front view similar to FIG. 13, but illustrating a modification.

FIG. 17 illustrates a modified, iron-type club head 120 which is similar to the head 100 of FIGS. 15 and 16, and like reference numerals have been used for like parts as appropriate. As in FIGS. 15 and 16, the weighted loop 10 is embedded in a body 102 of a suitable lightweight material, such as polyurethane. However, unlike the previous embodiment, the molded body 102 in this case does not cover the lower face or sole portion 122 of the loop 10. As illustrated in FIG. 14, the sole or bottom face 122 of the loop 10 is flat, and this provides a metal surface which contacts the ground when the golfer swings the club, reducing wear. The putter 110 of FIGS. 15 and 16 may be modified in a similar manner, so that the bottom or sole face 124 of loop 40 is exposed to form a metal sole portion to the club head, which will be much more resistant to wear than the polyurethane material of body 112.

Figure 18:
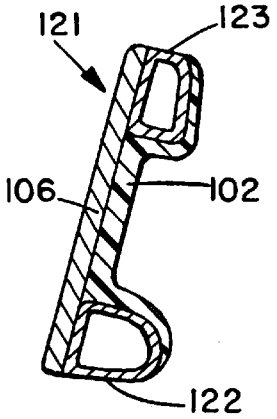
FIG. 18 is a cross-section, similar to FIG. 14, but illustrating a modified club head.

As illustrated in FIG. 18, the iron-type club 100 of FIGS. 13 and 14 may also be modified in a similar manner to provide a modified club head 121, in which the bottom of sole face 122 of loop 10 is exposed to form a metal sole portion to the club head, which will be much more resistant to wear than the polyurethane of the aluminum material of the body 102. FIG. 18 shows an alternative, recessed configuration of the body 102. Similarly, the total perimeter of the iron-type club 100 of FIGS. 13 and 14 may also be modified so that the bottom 122, toe face 124, and top 123 are exposed to form a metal periphery to the club head which will much improve resistance to damage both during contact with the ground and contact against other clubs int he golf bag during handling of the clubs.

In each of the embodiments of FIGS. 13 to 17, the metal face plate may be eliminated and the entire body of the club head, including the striking face, may be of a suitable lightweight molded material such as polyurethane.

The club head and method described above provide a new and improved perimeter weighting technique, allowing the same basic tubular perimeter loop shape to be used for numerous different weighting configurations. By pouring or injecting material into the loop while in a liquid or flowable state, and allowing the material to harden with the loop in a suitable orientation, the weighted inserts or parts will be locked in any selected position, while the lightweight material provides end faces for locating the end of a weighted insert at the desired position, as well as providing vibration damping. Thus, the tubular perimeter loop provides both a support frame for the remainder of the head, and a continuous perimeter cavity for inserting any desired combination of heavy, weighting material and lightweight material. The club head can be readily customized for different playing conditions and player characteristics, without requiring an expensive, custom-made club head for each set of playing and player conditions. The same basic tubular loop can be used in all cases for producing a wide variety of different weighting configurations.

This invention also allows the same basic head to be used for a large range of different swing weights. A larger or smaller amount of heavy metal may be placed in the tubular periphery in order to obtain heavier or lighter weights. Thus, the same basic club may be used for different players, such as men, women, and children. This allows clubs to be made in a large number of different swing weights both accurately and inexpensively.

Although some preferred embodiments of the present invention have been described above by way of example only, it will be understood by those skilled in the field that modifications may be made to the disclosed embodiments without departing from the scope of the present invention, which is defined by the appended claims.

We claim:

1. A golf club head, comprising:

a tube shaped to form at least one loop of predetermined shape corresponding to a selected club head periphery, the loop surrounding a central opening and having a front side, a rear side, a toe end, a heel end, an upper portion and a lower portion;

a member secured to the loop, the member extending at least over the loop opening and having a flat forward face forming at least part of a striking face for the club head; and an insert of a predetermined weighting material filling only a portion of the tube at a predetermined location on the loop to form a weighted portion of the tubular periphery.

2. The head as claimed in claim 1, wherein the tube has an end portion extending upwardly from the heel end of the loop for integration with a golf club shaft.

3. The head as claimed in claim 2, wherein the end portion of the tube comprises a hosel for attachment to a golf club shaft.

4. The head as claimed in claim 2, wherein the end portion of the tube comprises a golf club shaft.

5. The head as claimed in claim 1, wherein the front side of the loop has a flat face and the member attached to the loop comprises a plate secured over the front, flat face of the loop to cover the loop and the central opening of the loop.

6. The head as claimed in claim 1, wherein the member attached to the loop comprises a single plug completely filling the central opening, and the plug has a front face forming part of the striking face.

7. The head as claimed in claim 1, wherein the tube has a first wall thickness in the heel end of the loop and a second wall thickness around the rest of the loop, the first wall thickness being greater than the second wall thickness.

8. The head as claimed in claim 7, wherein a second, inner tube is secured inside the tube along a predetermined portion of the tube extending around the heel end of the loop.

9. The head as claimed in claim 1, wherein a hosel is secured to the loop.

10. The head as claimed in claim 9, wherein the hosel is formed integrally with said member forming the striking face.

11. The head as claimed in claim 1, wherein the member comprises an outer body of predetermined shape enclosing the loop.

12. The head as claimed in claim 1, wherein the outer body comprises a hollow shell secured over the loop.

13. The head as claimed in claim 12, wherein the shell is of aluminum.

14. The head as claimed in claim 1, wherein the weighting material comprises a mixture of tungsten balls and epoxy.

15. A golf club head, comprising:

a tube shaped to form at least one loop of predetermined shape corresponding to a selected club head periphery, the loop surrounding a central opening and having a front side, a rear side, a toe end, a heel end, an upper portion, and a lower portion;

a member secured to the loop, the member extending at least over the loop opening and having a flat forward face forming at least part of a striking face for the club head;

at least one insert of a predetermined weighting material filling a portion of the tube at a predetermined location on the loop to form a weighted portion of the periphery; and the tube being of generally D-shaped cross-section over at least part of the loop, and the rounded portion of the D-shape facing rearwardly at the rear side of the loop.

16. A golf club head, comprising:

a tube shaped to form at least one loop of predetermined shape corresponding to a selected club head periphery, the loop surrounding a central opening and having a front side, a rear side, a toe end, a heel end, an upper portion, and a lower portion;

a member secured to the loop, the member extending at least over the loop opening and having a flat forward face forming at least part of a striking face for the club head; and the tube containing inserts of at least two different materials filling different portions of the tube at predetermined locations on the loop, one of the materials being heavier than the other to form variably weighted portions around the tubular periphery.

17. The head as claimed in claim 8, wherein the tube is filled with inserts of said two materials around the entire loop.

18. The head as claimed in claim 17, wherein the lighter weight material is a hardened foam.

19. The head as claimed in claim 18, wherein the heavier material comprises a mixture of compacted tungsten balls and epoxy.

20. The head as claimed in claim 17, wherein the heavier material is a heavy metal.

21. The head as claimed in claim 17, wherein the heavier material is a mixture of tungsten powder and epoxy.

22. A golf club head, comprising:

a tube shaped to form at least one loop of predetermined shape corresponding to a selected club head periphery, the loop surrounding a central opening and having a front side, a rear side, a toe end, a heel end, an upper portion, and a lower portion;

a member secured to the loop comprising an outer body of predetermined shape enclosing the loop, the member having a flat forward face forming at least part of a striking face for the club head;

at least one insert of a predetermined weighting material filling a portion of the tube at a predetermined location on the loop to form a weighted portion of the periphery; and the outer body being molded over the loop to form a solid body in which the loop is embedded.

23. The head as claimed in claim 22, wherein the outer body is of polyurethane material.

24. The head as claimed in claim 22, wherein the outer body has a recess in said forward face, and a striking plate is secured in said recess.

25. The head as claimed in claim 22, wherein the lower portion of the loop has a lower, flat face, and the outer body is molded over loop to leave the lower flat face of the loop exposed to form at least part of the sole face of the head.

26. The head face as claimed in claim 25, wherein the loop has a toe face, a heel, and a top face, and the outer body is molded over the loop so as to leave the toe and top faces exposed in addition to the lower flat face.

* * * * *